United States Patent [19]

Wray

[11] Patent Number: 4,589,485

[45] Date of Patent: May 20, 1986

[54] DOWNHOLE TOOL UTILIZING WELL FLUID COMPRESSION

[75] Inventor: Gary Q. Wray, Duncan, Okla.

[73] Assignee: Halliburton Company, Duncan, Okla.

[21] Appl. No.: 666,699

[22] Filed: Oct. 31, 1984

[51] Int. Cl.[4] ..... E21B 47/00; E21B 33/10; E21B 34/08

[52] U.S. Cl. ..... 166/250; 166/142; 166/184

[58] Field of Search ..... 166/250, 373, 386, 387, 166/142, 146, 149, 151, 184, 185, 188, 191, 319, 321, 147, 186, 150, 152

[56] References Cited

U.S. PATENT DOCUMENTS

| | | | |
|---|---|---|---|
| Re. 29,562 | 3/1978 | Wray et al. | 166/164 X |
| 2,567,321 | 9/1951 | Courter | 166/183 |
| 2,951,536 | 9/1960 | Garrett | 166/145 |
| 3,008,521 | 11/1961 | Boucher | 166/152 |
| 3,032,116 | 5/1962 | Barry | 166/142 |
| 3,096,823 | 7/1963 | Crowe | 166/150 |
| 3,111,169 | 11/1963 | Hyde | 166/145 |
| 3,664,415 | 5/1972 | Wray et al. | 166/336 |
| 3,782,461 | 1/1974 | Watkins | 166/322 X |
| 3,856,085 | 12/1974 | Holden et al. | 166/321 X |
| 3,858,649 | 1/1975 | Wray et al. | 166/162 |
| 3,860,069 | 1/1975 | Wray et al. | 166/321 X |
| 3,915,228 | 10/1975 | Giebeler | 166/321 X |
| 3,964,305 | 6/1976 | Wray et al. | 166/321 X |
| 3,964,544 | 6/1976 | Farley et al. | 166/319 X |
| 3,976,136 | 8/1976 | Farley et al. | 166/319 X |
| 4,047,564 | 9/1977 | Nix et al. | 166/334 X |
| 4,059,153 | 11/1977 | Nix et al. | 166/321 X |
| 4,063,593 | 12/1977 | Jessup | 166/321 X |
| 4,076,077 | 2/1978 | Nix et al. | 166/321 X |
| 4,109,724 | 8/1978 | Barrington | 166/321 X |
| 4,109,725 | 8/1978 | Williamson et al. | 166/321 X |
| 4,113,012 | 9/1978 | Evans et al. | 166/321 X |
| 4,125,165 | 11/1978 | Helmus | 166/321 X |
| 4,144,937 | 3/1979 | Jackson et al. | 166/323 |
| 4,341,266 | 7/1982 | Craig | 166/324 X |
| 4,422,506 | 12/1983 | Beck | 166/324 |
| 4,429,748 | 1/1984 | Beck | 166/324 |
| 4,444,268 | 4/1984 | Barrington | 166/373 |
| 4,448,254 | 5/1984 | Barrington | 166/373 |

OTHER PUBLICATIONS

Halliburton Services Sales and Service Catalog No. 41, pp. 4014 and 4015.

*Primary Examiner*—Stephen J. Novosad
*Assistant Examiner*—Thuy M. Bui
*Attorney, Agent, or Firm*—James R. Duzan; L. Wayne Beavers

[57] ABSTRACT

A downhole tool apparatus includes a housing having an operating element disposed therein. An actuating piston is disposed in the housing and is operably associated with the operating element so that the operating element is operated in response to movement of the actuating piston relative to the housing. A packer is disposed about the housing for sealing between the housing and a well bore and for thereby defining an upper end of a sealed well annulus zone external of the housing. A compression passage is disposed through the housing and communicates a low pressure side of the actuating piston with the sealed well annulus zone exterior of the housing. A lower packer is longitudinally spaced from the upper packer defines a lower end of the sealed well annulus zone. The upper and lower packers are set to define the sealed well annulus zone and to define a trapped reference pressure therein equivalent to the hydrostatic pressure of well annulus fluid. The sealed well annulus zone also provides a trapped volume of well fluid which acts as a compressible fluid spring to oppose the movement of the actuating piston. The actuating piston operates in response to increased well annulus pressure above the upper packer.

19 Claims, 3 Drawing Figures

DOWNHOLE TOOL UTILIZING WELL FLUID COMPRESSION

BACKGROUND OF THE INVENTION

1. Field Of The Invention

The present invention relates generally to downhole tools, and particularly relates to tools utilizing compressible fluid to help restore an actuating piston to an original position thereof.

2. Description Of The Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

Additionally, these prior art tools have often provided a volume of fluid, either liquid or gas, through which this reference pressure is transmitted. Sometimes this volume of fluid provides a compressible fluid spring which initially stores energy when the differential area piston compresses that fluid, and which then aids in returning the differential area piston to its initial position.

One manner of providing a fixed reference pressure is by providing an essentially empty sealed chamber on the low pressure side of the power piston, which chamber is merely filled with air at the ambient pressure at which the tool was assembled. Such a device is shown, for example, in U.S. Pat. No. 4,076,077 to Nix et al. with regard to its sealed chamber 42. This type of device does not balance hydrostatic annulus pressure across the power piston as the tool is run into the well. This device does not provide a fluid spring to aid in return of the power piston.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown, for example, in U.S. Pat. No. 3,664,415 to Wray et al. with regard to its nitrogen cavity 44. This type of device does not balance hydrostatic annulus pressure across the power piston as the tool is run into the well. The Wray et al. device utilizes the compressed nitrogen gas in cavity 44 to bias the piston 42 thereof downwardly.

Another approach has been to use a charge of inert gas as described above, in combination with a supplementing means for supplementing the gas pressure with the hydrostatic pressure of the fluid in the annulus contained between the well bore and the test string, as the test string is lowered into the well. Such a device is shown, for example, in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then, well annulus pressure may be increased to create a pressure differential across the power piston to actuate the tool. The Holden et al. device utilizes the energy stored in compression of the nitrogen gas within chamber 128 to assist in returning the power piston 124 to its upper position.

Also, rather than utilize a compressible inert gas such as nitrogen within such tools, it has been proposed to use a large volume of a somewhat compressible liquid such as silicone oil as a compressible fluid spring on the low pressure side of the tool. Such a device is seen, for example, in U.S. Pat. No. 4,109,724 to Barrington.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well. The power piston 35 of the Craig device is returned to its original position by a mechanical coil compression spring 36 without the aid of any compressed volume of fluid.

Another relatively recent development is shown in U.S. Pat. No. 4,113,012 to Evans et al. This device utilizes fluid flow restrictors 119 and 121 to create a time delay in any communication of changes in well annulus pressure to the lower side of its power piston. During this time delay, the power piston moves from a first position to a second position. The particular tool disclosed by Evans et al. utilizes a compressed nitrogen gas chamber in combination with a floating shoe which transmits the pressure from the compressed nitrogen gas to a relatively noncompressible liquid filled chamber. This liquid filled chamber is communicated with the well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

It is apparent from the numerous examples set forth above that it is well known in the prior art to create a trapped reference pressure within a tool by communicating a chamber within the tool with the well annulus, and then isolating that chamber to trap the reference pressure within the tool. In combination with that concept, a number of these prior tools have also utilized a volume of compressible gas or of a relatively compressible liquid such as silicone oil contained within the tool to act as a fluid spring to aid in returning the power piston to its initial position. This compressed gas or silicone oil generally is separated from the trapped well fluid providing the reference pressure by a floating piston so that the trapped well fluid and the compressed gas or silicone oil are always at the same pressure.

Those ones of the various prior art devices discussed above which do utilize a compressible fluid spring to aid in returning the power piston to its original position rely upon the compressibility of the compressed gas or silicone oil, and not upon compressibility of the well fluid itself which may be trapped within the tool.

There are disadvantages inherent in using either a large volume of a relatively compressible liquid such as silicone oil or a volume of compressible gas to account for the volume change within a tool on the low pressure side of the power piston.

When utilizing a tool which provides a sufficient volume of compressible silicone oil to accommodate the volume change required on the low pressure side of the tool, the tool generally becomes very large because of the large volume of silicone oil required in view of the relatively low compressibility thereof.

On the other hand, there is a danger in tools that utilize inert gas such as nitrogen, as there is in any high pressure vessel.

SUMMARY OF THE INVENTION

The present invention provides a tool which instead of trapping well fluid within the tool to create a reference pressure, utilizes a passage directly communicating the low pressure side of the power piston with an isolated portion of the well annulus so that the reference pressure is provided by this isolated portion of the well annulus. Additionally, the isolated portion of the well annulus has such a large volume that the compressibility of well fluid, generally drilling mud or water, within that isolated zone may be utilized as a compressible fluid spring to aid in returning the power piston of the tool to its initial position.

The downhole tool apparatus of the present invention includes a housing having an operating element disposed therein. An actuating piston is also disposed in the housing and is operably associated with the operating element so that the operating element is operated in response to movement of the actuating piston relative to the housing.

An upper packer is disposed about the housing for sealing between the housing and a well bore and for thereby defining an upper end of a sealed well annulus zone external of the housing.

A compression passage is disposed through the housing for communicating a low pressure side of the actuating piston with the sealed well annulus zone exterior of the housing.

The lower end of the sealed well annulus zone is defined by a lower packer means which is separated from the upper packer means by a spacer tubing.

When this tool is placed within a well bore, and the upper and lower packer means are sealed against the well bore, the low pressure side of the power piston is then communicated with the sealed well annulus zone defined between the upper and lower packer means, and the high pressure side of the power piston is communicated with an upper portion of the well annulus above the upper packer means.

The apparatus is then operated by increasing well annulus pressure in the upper portion of the well annulus above the upper packer means, which creates a differential pressure across the actuating piston which moves it in order to operate the operating element of the tool.

When the actuating piston moves, the well fluid trapped within the sealed well annulus zone defined between the upper and lower packer means is compressed.

To move the operating element and the actuating piston back to their respective initial positions, the pressure in the upper portion of the well annulus above the upper packer means is decreased, and the compressed well fluid trapped within the sealed well annulus zone expands thus pushing the actuating piston back toward its initial position.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
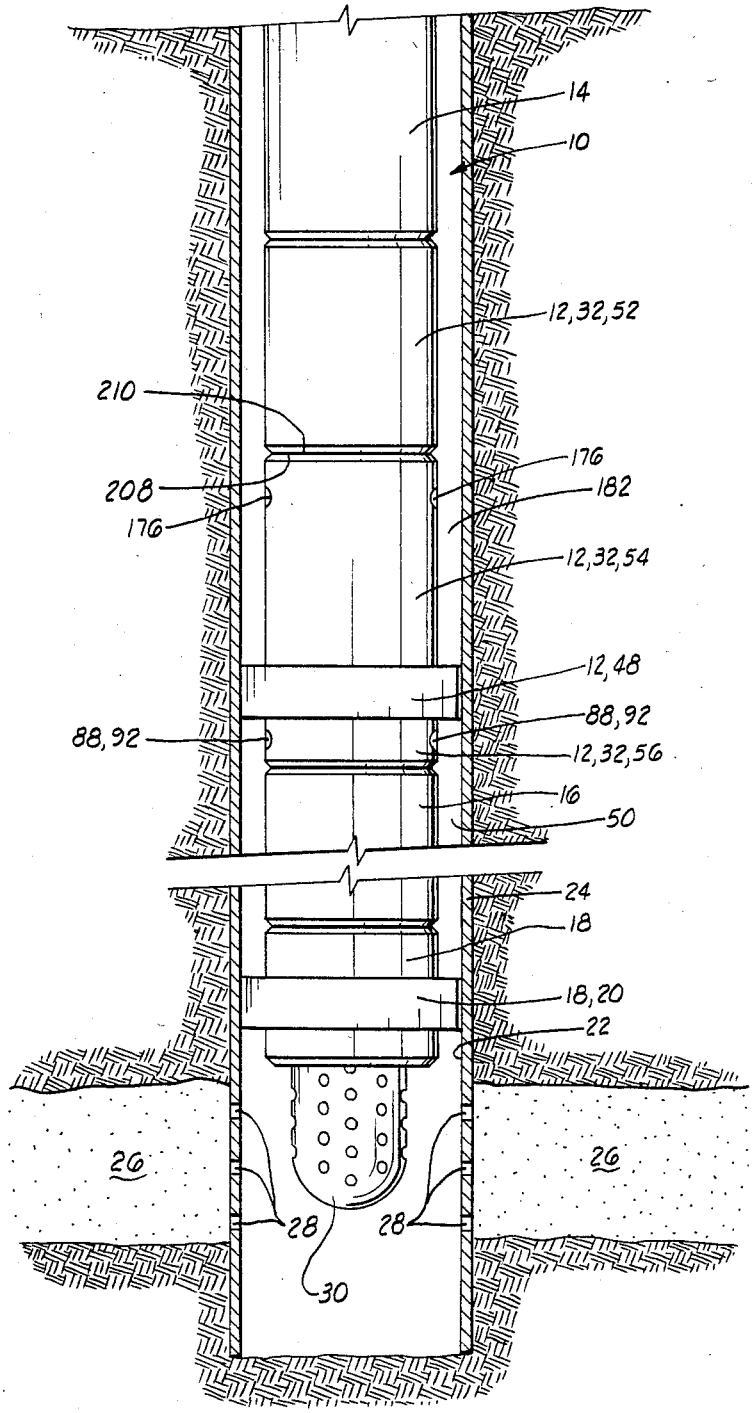
FIG. 1 is a schematic elevation view of a well test string incorporating the downhole tool apparatus of the present invention, in place within a well.

Referring now to the drawings, and particularly to FIG. 1, a well test string 10 is thereshown, which includes a well tester valve apparatus 12 of the present invention. The well tester valve apparatus 12 may also generally be referred to as a downhole tool apparatus 12.

An upper end of the well tester valve apparatus 12 is connected to a lower end of a tubing string 14. A lower end of the well tester valve apparatus 12 is connected to a spacer tubing 16, which has a lower packer assembly 18 connected to the lower end thereof.

The lower packer means 18 has a lower packing element 20 which is sealed against a well bore 22 of a well defined by well casing 24.

The lower packing element 20 is sealed against well bore 22 at an elevation above a subsurface formation 26 which intersects the well defined by casing 24.

The subsurface formation 26 is communicated with the well bore 22 through a plurality of perforations 28.

Fluid from the subsurface formation 26 may flow into a central bore (not shown) of lower packer means 18 through a perforated tail pipe 30.

Figure 2A:
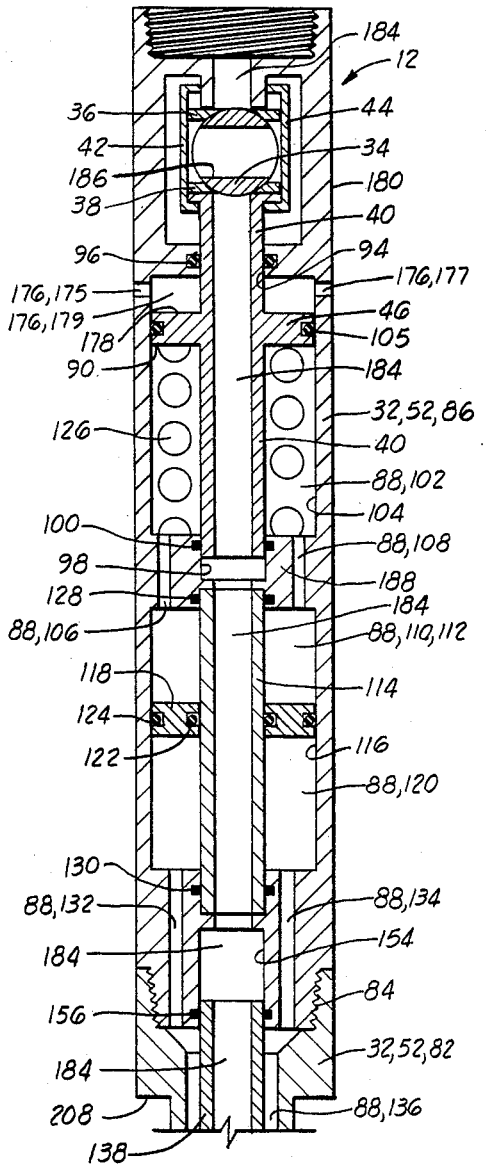
FIGS. 2A–2B comprise an elevation section schematic illustration of the downhole tool apparatus of the present invention.
Figure 2B:
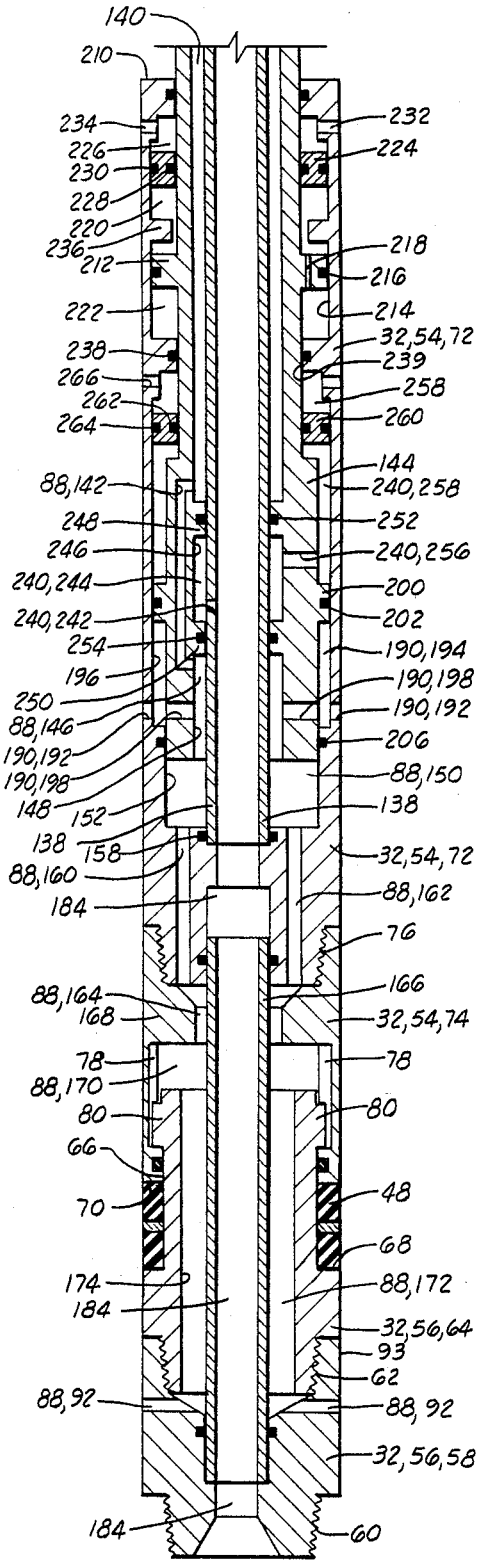

Referring now to FIGS. 2A–2B, the details of construction of the well tester valve apparatus 12 will be described.

The apparatus 12 has a housing generally designated by the numeral 32.

An operating element generally designated by the numeral 34 is disposed within the housing 32. In the embodiment shown in FIG. 2A, the operating element 34 is a full opening spherical ball valve element held between upper and lower valve seats 36 and 38. The ball valve 32 is rotated within seats 36 and 38 in response to movement of an actuating mandrel 40 which is connected to actuating arms schematically illustrated as 42 and 44. The arms 42 and 44 have eccentric lugs (not shown) which engage the ball valve member 34 to rotate the same. The ball valve member 34 and associated structure are shown only very schematically in FIG. 2A, since the structure thereof is well known in the art. For a more detailed description of the ball valve member and its associated seats and actuating arms, reference is made to U.S. Pat. No. 3,856,085 to Holden et al., the details of which are incorporated by reference herein.

An actuating piston means 46, which may also be referred to as a power piston means 46, is disposed within the housing 32 and is operably associated with the operating element 34 through the actuating mandrel 40 and actuating arms 42 and 44 previously described, so that the operating element 34 is operated in response to movement of the actuating piston means 46 relative to the housing 32.

An upper packer means 48 is disposed about the housing 32, for sealing between the housing 32 and the well bore 22, as shown in FIG. 1, and for thereby defining an upper end of a sealed well annulus zone 50 which is external of the housing 32.

The housing 32 includes first, second and third portions 52, 54 and 56, respectively.

The first and second housing portions 52 and 54 may generally be described as upper first and second housing portions 52 and 54. The third housing portion 56 may generally be described as a lower third housing portion 56.

Beginning at the bottom of FIG. 2B, lower third housing portion 56 includes a lower adapter 58 having a threaded lower end 60 for connection thereof to spacer tubing 16.

An upper end of lower adapter 58 is connected at threaded connection 62 to a lower end of a packer housing section 64.

The upper packer means 48 is disposed about a cylindrical outer surface 66 of packer housing section 64, and its lower end engages an upward facing shoulder 68 of packer housing section 64 of lower third housing portion 58.

The upper end portion of packer housing section 64 of lower third housing portion 56 is telescopingly received within a lower end of upper second housing portion 54.

Upper packer means 48 is a compression packer means and it is located between the previously mentioned upward facing shoulder 68 of lower third housing portion 56 and a downward facing shoulder 70 defined on a lower end of upper second housing portion 54.

The upper packer means 48 is constructed so that it is radially expanded to seal against well bore 22 upon telescopingly collapsing relative motion between upper second housing portion 54 and lower third housing portion 56.

The upper second housing portion 54 includes an outer bypass housing section 72 and a splined housing section 74 threadedly connected together at threaded connection 76.

The splined housing section 74 has a plurality of radially inward directed splines 78 which interlock with a plurality of radially outward directed splines 80 of packer housing section 64, thus interlocking the upper second housing portion 54 and lower third housing portion 56 of housing 32 for allowing relative longitudinal motion therebetween while preventing relative rotational motion therebetween.

The upper first housing portion 52 includes an inner bypass housing section 82 which has its upper end threaded connected at threads 84 to a power housing section 86.

A compression passage means 88 is disposed through the housing 32 for communicating a lower side 90 of actuating piston means 46 with the sealed well annulus zone 50. The lower side 90 of actuating piston 46 may also be referred to as a first side or as a low pressure side of actuating piston 46.

Compression passage means 88 extends from lower side 90 of actuating piston means 46 to a pair of compression ports 92 extending radially through a side wall of lower adapter 58 near the bottom of FIG. 2B. Compression ports 92 are communicated with a lower exterior surface 93 of housing 32. The various openings comprising compression passage 88 will now be described, beginning at the upper end of compression passage 88.

The actuating mandrel 40, previously mentioned, has an upper portion above actuating piston means 46 closely received within a reduced diameter inner bore 94 of housing 32 with a resilient seal being provided therebetween by O-ring seal means 96. A lower portion of actuating mandrel 40 is closely and sealingly received within a second reduced diameter bore 98 of housing 32 with a seal being provided therebetween by resilient O-ring seal means 100.

Compression passage 88 includes an annular spring chamber 102 defined between the lower portion of actuating mandrel 40 and an inner cylindrical surface 104 of housing 32.

Actuating piston 46 is closely received within inner cylindrical surface 104 of power housing section 86 and a seal is provided therebetween by resilient O-ring seal 105.

Spring chamber 102 is communicated by a plurality of longitudinal ports such as 106 and 108 with an upper portion 110 of an annular lubricant chamber 112 defined between an outer surface of a first flow tube 114 and an inner cylindrical surface 116 of housing 32.

Lubricant chamber 112 is divided by an annular floating piston 118 into the upper chamber portion 110 and a lower chamber portion 120.

Floating piston 118 includes annular inner and outer resilient O-ring seals 122 and 124, respectively, which seal against flow tube 114 and inner cylindrical surface 116, respectively.

The spring chamber 102, longitudinal ports 106 and 108, and upper portion 110 of lubricant chamber 112 are filled with a suitable non-corrosive fluid such as lubricating oil.

A coil compression spring 126 is disposed in the spring chamber 102, and the purpose of the lubricating oil in spring chamber 102 is to prevent corrosion of the coil spring 126. In the event a spring mechanism is utilized which can satisfactorily withstand the particular well fluids involved in a given situation, then the floating piston 118 can be deleted.

When the floating piston 118 is utilized, however, the lower portion 120 of lubricant chamber 112 is filled with well fluid, and fluid pressure is freely transmitted between the upper and lower portions 110 and 120 of lubricant chamber 112 by the freely floating annular piston 118.

The upper and lower ends of first flow tube 114 are closely received within reduced diameter bores of housing 32 and seals are provided therebetween by resilient O-ring seals 128 and 130.

Lower portion 120 of lubricant chamber 112 is communicated through a pair of longitudinal ports 132 and 134 with an annular space 136 defined between an upper portion of a second flow tube 138 and an upper inner bore 140 of inner bypass housing section 82.

Compression passage 88 includes an offset longitudinal passage 142 disposed through an enlarged diameter portion 144 of inner bypass housing section 82.

A lower end of offset longitudinal passage 142 is communicated with an annular space 146 defined between a lower portion of section flow tube 138 and a lower inner bore 148 of inner bypass housing section 82.

Annular cavity 146 is communicated with an annular cavity 150 defined between a lowermost portion of second flow tube 138 and an inner cylindrical surface 152 of outer bypass housing section 72.

Second flow tube 138 has its upper end closely and slidably received within a lower inner bore 154 of power housing section 88 with a sliding seal being provided therebetween by resilient O-ring seal 156. A lower end of second flow tube 138 is closely received within a reduced diameter bore of outer bypass housing section 72 with a seal being provided therebetween by resilient O-ring seal means 158.

Compression passage means 88 further includes a pair of longitudinal ports 160 and 162 disposed through a lower end of outer bypass housing section 72 and communicating annular cavity 150 with an annular cavity 164 defined between a third flow tube 166 and a reduced inner diameter upper portion 168 of splined housing section 74.

Annular space 164 is communicated with another annular space 170 defined between third flow tube 166 and a lower portion of splined housing section 74.

Annular cavity 170 is communicated with an annular cavity 172 defined between third flow tube 166 and an inner bore 174 of packer housing section 64.

Annular cavities 170 and 172 are also parts of compression passage 88.

Finally, the lower end of annular cavity 172 is communicated with the compression ports 92 disposed through lower adapter 58, and thus with sealed well annulus zone 50.

A power passage means 176 is disposed through housing 32 for communicating an upper side 178 of actuating piston 46 with an upper exterior surface 180 of housing 32 above upper packer means 48 and thus with an upper portion 182 of the well annulus above the upper packer means 48, so that actuating piston means 46 is moved relative to housing 32 in response to changes in pressure in the upper well annulus portion 182 relative to pressure in the sealed well annulus zone 50.

Upper side 178 of actuating piston 46 may also be referred to as a second side or a high pressure side of actuating piston 46.

The power passage 176 includes a pair of radial power ports 175 and 177 which communicate upper well annulus portion 182 with an annular space 179 defined between inner surface 104 of power housing section 86 and the upper portion of actuating mandrel 40 above the actuating piston 46.

The housing 32 of well tester valve apparatus 12 has a flow passage 184 disposed longitudinally through the center thereof. The flow passage 184 is coincident with the central bores of actuating mandrel 40, first flow tube 114, second flow tube 138, third flow tube 166, and the various central bores of the housing portions 52, 54 and 56.

Fluid produced from subsurface formation 26 flows inward through perforated tail pipe 30 up through a central bore of lower packer means 18 and a bore of spacer tubing 16, then through the flow passage 184 of the apparatus 12 and into a bore of tubing string 14. Also, if the well test string 10 is being utilized to treat the subsurface formation 26, treatment fluids may be pumped downward through the tubing string 14 and through the flow passage 184, then through the bore of packer means 18 and out the perforated tail pipe 30 into the subsurface formation 26.

The operating element 34 of the apparatus 12 is a full open ball-type flow tester valve 34 which is disposed in the flow passage 184 of housing 32. The operating element 34 is illustrated in FIG. 2A in a closed first position thereof wherein the flow passage 184 is closed. Similarly, the actuating piston 46 and actuating mandrel 40 are in an upper first position thereof corresponding to the closed first position of the ball valve 34.

When actuating piston 46 is moved downward from the position illustrated in FIG. 2A to a lower second position thereof relative to housing 32, in a manner that will be further described below, the ball valve 34 is rotated to an open second position wherein its central bore 186 is aligned with the flow passage 184.

The flow passage 184 disposed through housing 32 of apparatus 12 is completely isolated from compression passage means 88 previously described.

The coil spring 126 previously mentioned can be further described as a mechanical spring biasing means 126 which is operably associated with the actuating piston 46 for biasing the actuating piston means 46 back towards its first position illustrated in FIG. 2A corresponding to the closed first position of ball valve 34 from its lower second position (not shown) corresponding to the open second position of ball valve 34. The coil compression spring 126 is disposed between the lower side 90 of actuating piston 46 and a reduced inner diameter portion 188 of power housing section 86.

The coil compression spring 126 is of sufficient size and strength that it provides a sufficient biasing force to return the actuating piston 46 to its upper first position illustrated in FIG. 2A, even in the absence of any biasing force from well fluid compressed within the compression passage 88 and the sealed well annulus zone 50 in a manner that is further described below.

Referring now to FIG. 1, the upper and lower packer means 48 and 20, respectively, are longitudinally spaced by a distance sufficient that the sealed well annulus zone 50 has a volume sufficient that well fluid, such as drilling mud or water, trapped in the sealed well annulus zone 50 may be compressed upon movement of actuating piston 46 downward from its first position illustrated in FIG. 2A to its second position corresponding to the open position of ball valve 32 to decrease a volume of the trapped well fluid by an amount substantially equal to a displacement of the actuating piston 46 as the actuating piston 46 moves between its first and second positions.

The displacement of actuating piston 46 is determined by multiplying the annular area defined between seals 100 and 105 by the longitudinal stroke of actuating piston 46.

The apparatus 12 has a bypass passage means 190 for allowing well fluid to flow through the apparatus 10 as it is lowered into the well bore to prevent a swabbing action by the upper packer means 48.

Bypass passage means 190 includes upper bypass ports 192 disposed through outer bypass housing section 72, annular cavity 194 defined between enlarged diameter portion 144 of inner bypass housing section 82 and an inner cylindrical surface 196 of outer bypass housing section 72, and bypass valve ports 198 disposed radially through enlarged diameter portion 144 of inner bypass housing section 82 to communicate annular space 194 with the annular space 146 of compression passage means 88. The compression passage means 88 then communicates bypass passage means 190 with the outer surface 93 of lower third housing portion 56 as seen in FIG. 2B thus providing communication from below upper packer means 48 to above upper packer means 48 through the apparatus 12.

Enlarged diameter portion 144 of inner bypass housing section 82 includes a radially outward extending flange portion 200 closely slidingly received within inner cylindrical surface 196 of outer bypass housing section 72 with a resilient seal being provided therebetween by resilient sliding O-ring 202.

The lower end of inner bypass housing section 82 is closely and slidingly received within the inner cylindrical surface 152 of outer bypass housing section 72 with a seal being provided therebetween by resilient O-ring seal 206.

The inner bypass housing section 82 of first upper housing portion 52 is telescopingly received within the outer bypass housing section 82 of upper second housing portion 54. An uppermost seal is provided therebetween by O-ring 207. The upper first and second housing portions 52 and 54 are shown in FIGS. 2A–2B in their telescopingly extended position wherein the bypass passage means 190 is open. This is the position the tool is in as it is run into the well.

After the apparatus 12 has been lowered into its desired final position within the well, and when weight is subsequently slacked off on the tubing string 14, to set the upper and lower packers 48 and 20, the inner bypass housing section 82 and outer bypass housing section 72 telescope together so that a downward facing shoulder 208 of inner bypass housing section 82 then abuts an upper end 210 of outer bypass housing section 72 as schematically shown in FIG. 1.

When the inner bypass housing section 82 moves downward relative to outer bypass housing section 72, the bypass valve ports 198 move below O-ring seal 206 thus closing the bypass passage means 190.

As the apparatus 12 is being lowered into the well, it is necessary to prevent premature closing of the bypass passage means 190. This is accomplished by a time delay piston 212 which is operably associated with inner bypass housing section 82 and is closely slidingly received within an inner bore 214 of outer bypass housing section 72 with a seal being provided therebetween by resilient sliding O-ring piston seal 216.

Time delay piston 212 has a metering orifice 218 disposed therethrough. Metering orifice 218 communicates an upper annular metering chamber 220 with a lower annular metering chamber 222.

Upper metering chamber 220 is defined between inner and outer bypass housing sections 82 and 72 above time delay piston 212, and lower metering chamber 222 is defined between inner and outer bypass housing sections 82 and 72 below time delay piston 212.

The upper and lower metering chambers 220 and 222 are filled with a suitable metering fluid such as oil.

The upper end of upper metering chamber 220 is defined by a second annular floating piston 224 which is slidably received within an annular space 226 defined between inner and outer bypass housing sections 82 and 72. Piston 224 includes inner and outer seals 228 and 230, respectively, sealing against inner and outer bypass housing sections 82 and 72, respectively.

A portion of annular space 226 above floating piston 224 is communicated through radial ports 232 and 234 with the upper well annulus portion 182.

A longitudinally upwardmost position of inner bypass housing section 82 relative to outer bypass housing section 72 is defined by engagement of time delay piston 212 with a radially inward extending flange 236 of outer bypass housing section 72.

A lower extremity of lower metering chamber 222 is defined by a resilient O-ring seal 238 sealing between inner bypass housing section 82 and an inner bore 239 of outer bypass housing section 72.

Thus relative longitudinal movement of inner bypass housing section 82 relative to outer bypass housing section 72 is impeded by the retarding action provided by time delay piston 212. For time delay piston 212 to move relative to outer bypass housing section 72, metering fluid must flow through the metering orifice 218 between the upper and lower metering chambers 220 and 222.

As previously mentioned, the apparatus 12 is sometimes utilized to inject treatment fluids into the subsurface formation 26, and as will be understood by those skilled in the art, this sometimes involves very high injection pressure substantially exceeding the hydrostatic pressure which would be present within the well annulus.

During such high injection pressures, it is necessary to provide a means for preventing these high injection pressures which are present in the flow passage 184 from pumping the apparatus 12 back to the telescopingly extended position of inner bypass mandrel section 82 relative to outer bypass mandrel section 72. This is provided by a pressure balance passage means 240.

The pressure balance passage means 240 includes radial ports 242 disposed through second flow tube 138 and communicating flow passage 184 with an annular cavity 244 of pressure balance means 240. The annular cavity 244 is defined between an inner cylindrical surface 246 of inner bypass housing section 82 and the outer surface of second flow tube 138. The upper and lower extremities of annular cavity 244 are defined by radially inward extending flanges 248 and 250 of inner bypass housing section 82, each of which is closely slidingly received about the exterior surface of second flow tube 138 with sliding seals being provided therebetween by resilient O-ring seal means 252 and 254, respectively.

Pressure balance passage means 240 further includes a radial port 256 disposed through enlarged diameter portion 144 of inner bypass housing section 82 and communicating annular cavity 244 with an irregular annular cavity 258 defined between inner and outer bypass housing sections 82 and 72 above flange 200.

An upper extremity of irregular annular cavity 258 has a third annular floating piston 260 disposed therein which slidably sealingly engages inner and outer bypass housing sections 82 and 72 with seals being provided therebetween by resilient O-ring seals 262 and 264, respectively.

An upper portion of irregular annular cavity 258 above annular floating piston 260 is communicated by radial ports 266 with upper well annulus portion 182.

The pressure balance passage means 240 functions in the following manner.

After the inner bypass housing section 82 has been moved longitudinally downward relative to outer bypass housing section 72 until shoulder 208 abuts upper end 210 of outer bypass housing section 72, so as to close bypass passage means 190, the internal pressure from within flow passage 184 is communicated through ports 242, annular cavity 244 and ports 256 of pressure balance passage means 240 so that said internal pressure from flow passage 184 acts downwardly on an annular area of inner bypass housing section 82 defined between seals 202 and 262.

Thus, high fluid injection pressures within the flow passage 184 will act downwardly on inner bypass housing section 82 thus holding the bypass passage means 190 closed.

METHODS OF OPERATION

Referring now both to FIG. 1 and to FIGS. 2A–2B, the method of operating the downhole tool string 10 will now be described.

First, the well test string 10 is made up by connecting the well tester valve apparatus 12 to the lower end of tubing string 14, and connecting the spacer tubing 16, lower packer means 18 and perforated tail pipe 30 to the lower end of well tester valve apparatus 12.

Then, the well test string 10 is lowered into place within the well until it reaches the desired location wherein the packing element 20 of lower packer means 18 is located just above the upper extremity of the subsurface formation 26 to be tested or treated.

As the apparatus 10 is being lowered into the well, the ball valve 34 thereof is in its first closed position as illustrated in FIG. 2A.

Also, as the apparatus 12 is being lowered into the well, the bypass passage means 190 is open. Premature closure of the bypass passage means 190 due to temporary compressional forces across the apparatus 12 created by obstructions and the like which might be encountered as the apparatus is lowered into the well is prevented due to the action of time delay piston 212.

Also, as the apparatus 12 is lowered into the well, hydrostatic well annulus pressure is balanced across the actuating piston 46 since both the power passage means 176 and the compression passage means 88 are communicated with a common portion of the well annulus, since the upper packer means 48 is in a contracted position.

After the apparatus 12 is located in its desired position within the well bore with the packing element 20 of lower packing means 18 immediately above the upper extremity of the subsurface formation 26, weight is picked up from the tubing string 14 and then right-hand torque is applied to the tubing string 14 and weight is slacked off on the tubing string 14 to set the lower packer 18. This rotation and reciprocation of the tubing string 14 accomplishes several functions. It causes the packing element 20 of lower packer means 18 to be expanded and seal against the well bore 22 as illustrated in FIG. 1. When weight is slacked off on the tubing string 18, it also closes the bypass passage means 190 of the apparatus 12 and then the upper packer means 48 is longitudinally compressed between shoulders 68 and 70 of lower third housing portion 56 and upper second housing portion 54 so that upper packer means 48 is also expanded to seal against the well bore as shown in FIG. 1.

The upper and lower packer means 48 and 20 define the sealed well annulus zone 50 therebetween.

The sealed well annulus zone 50 is communicated with the low pressure side 90 of actuating piston 46 through the compression passage means 88.

Then, well annulus pressure in the upper well annulus portion 182 is increased by a pump located at the surface (not shown) of the well and that increased pressure, which may be referred to as an actuating pressure, is applied to the high pressure side 178 of actuating piston 46 through the power passage means 176.

Then, the actuating piston 46 moves downward relative to housing 32 in response to the difference between the acting pressure in upper well annulus portion 182 and the trapped well fluid pressure within sealed well annulus zone 50, thereby opening the ball valve 34.

The pressure trapped within sealed well annulus zone 50 between upper and lower packer means 48 and 20 is initially equal to the hydrostatic annulus pressure at the corresponding elevation prior to the time the upper and lower packer means 48 and 20 were set. This trapped pressure within sealed well annulus zone 50 provides a reference pressure which must be overcome by the increased pressure in upper well annulus portion 182 to operate the actuating piston 46.

As the actuating piston 46 moves downward within the housing 32, it displaces a volume of fluid and compresses the well fluid trapped within compression passage means 88 and the sealed well annulus zone 50, thus storing in fluid compression a portion of the energy applied to the actuating piston 46 to move the actuating piston 46.

The well fluid contained within compression passage means 88 and sealed well annulus zone 50 is generally either drilling mud or water, both of which have a very similar compressibility factor.

Although drilling mud and water are often referred to as being incompressible, they are compressible to some extent as will be understood by those skilled in the art.

In order to provide the appropriate volume change necessary to allow the actuating piston 46 to move downward, it is necessary that the volume of fluid contained within the compression passage 88 and particularly within the sealed well annulus zone 50 be large enough that under the particular operating conditions the volume of trapped drilling mud or water can compress by an amount at least as great as the displacement af actuating piston 46. The relevant operating conditions which determine the required volume include initial trapped pressure, operating temperature, and operating pressure differential applied across the actuating piston 46.

For example, it has been determined that for an actuating piston displacement of 14.69 cubic inches, the volume of the sealed well annulus zone 50 should be at least approximately 9000 cubic inches. This volume for the sealed well annulus zone 50 is accomplished with the well casing 24 having an internal diameter of 6.094 inches, and the spacer tubing 16 having an external diameter of 4.5 inches, by providing a longitudinal spacing between upper and lower packer means 48 and 20 of at least approximately 60 feet.

With those parameters, the well test string 10 can operate at a depth of approximately 15,000 feet, at an initial hydrostatic pressure of approximately 13,000 psi with an operating pressure differential across the actuating piston 46 of approximately 1500 psi in a well having a well fluid operating temperature in a range of about 300°–375° F.

As will be understood by those skilled in the art, the required volume of the sealed well annulus zone 50 can be calculated based upon the compressibility factor for the appropriate well fluid at the appropriate initial hydrostatic pressure, operating temperature, and operating pressure differential. This compressibility factor varies with each well fluid, and varies with temperature and pressure.

After the test or treatment of the subsurface formation 26 is completed, the high pressure previously placed on upper well annulus portion 182 is released so that upper well annulus portion 182 returns to hydrostatic pressure, and then the higher pressure trapped within the sealed well annulus zone 50 causes the well fluid in sealed well annulus zone 50 and compression passage 88 to once again expand and push the actuating piston 46 upward relative to housing 32 to its first position as illustrated in FIG. 2A corresponding to the closed position of ball valve 34.

The coil compression spring 126 aids in moving the actuating piston 146 back upward to its first position, and the coil spring 126 provides a safety factor in that it is designed to be strong enough to return the actuating piston 46 to its first position even if pressure within the sealed well annulus zone 50 were to be lost.

After the ball valve 34 is re-closed, the upper and lower packers 48 and 20 are released by picking up and rotating the tubing string 14.

Thus it is seen that the apparatus and methods of the present invention readily achieve the ends and advantages mentioned as well as those inherent therein. While certain preferred embodiments of the present invention have been illustrated for the purposes of the present disclosure, numerous changes in the arrangement and construction of parts and steps may be made by those skilled in the art, which changes are encompassed within the scope and spirit of the present invention as defined by the appended claims.

What is claimed is:

1. A downhole tool apparatus, comprising:

a housing;

an operating element disposed in said housing, said operating element being a flow tester valve disposed in a flow passage of said housing, said flow tester valve being movable between a closed first position thereof wherein said flow passage is closed, and an open second position thereof wherein said flow passage is open;

an actuating piston means disposed in said housing, said actuating piston means being operably associated with said operating element so that said operating element is operated in response to movement of said actuating piston means relative to said housing;

packer means, disposed about said housing, for sealing between said housing and a well bore and for thereby at least partially defining a sealed well annulus zone external of said housing; and compression passage means, disposed through said housing, for communicating a first side of said actuating piston means with said sealed well annulus zone exterior of said housing.

2. The apparatus of claim 1, wherein said apparatus further includes:

a power passage means, disposed through said housing, for communicating a second side of said actuating piston means with an upper exterior surface of said housing above said packer means and thus with an upper well annulus portion defined between said housing and said well bore above said packer means, so that said actuating piston means is moved relative to said housing in response to changes in pressure in said upper well annulus portion relative to pressure in said sealed well annulus zone.

3. The apparatus of claim 2, wherein:

said compression passage means is further characterized as a means for communicating said first side of said actuating piston means with a lower exterior surface of said housing below said packer means and thus with said sealed well annulus zone.

4. The apparatus of claim 1, wherein:

said housing includes upper and lower housing portions telescopingly connected together; and said packer means is a compression packer means located between a downward facing shoulder of said upper housing portion and an upward facing shoulder of said lower housing portion, so that said packer means is expanded upon telescopingly collapsing relative motion between said upper and lower housing portions.

5. The apparatus of claim 4, wherein:

said housing includes longitudinal spline means, interlocking said upper and lower housing portions, for allowing relative longitudinal motion between said upper and lower housing portions while preventing relative rotational motion therebetween.

6. The apparatus of claim 1, wherein:

said compression passage means is isolated from said flow passage of said housing.

7. The apparatus of claim 1, further comprising:

mechanical spring biasing means, operably associated with actuating piston means and said housing, for biasing said actuating piston means back toward a first position thereof corresponding to a first position of said operating element, from a second position thereof corresponding to a second position of said operating element.

8. The apparatus of claim 7, wherein:

said mechanical spring biasing means is a coil compression spring disposed between said first side of said actuating piston means and said housing.

9. The apparatus of claim 7, wherein:

said mechanical spring biasing means is further characterized as a means for providing sufficient biasing force to return said actuating piston means to its first position without the assistance of any biasing force from well fluid compressed in said sealed well annulus zone.

10. A downhole tool string including the downhole tool apparatus of claim 1, wherein:

said packer means is further characterized as an upper packer means; and said tool string further comprises:

a spacer tubing having an upper end connected to a lower end of said housing; and a lower packer means, connected to said spacer tubing and longitudinally spaced from said upper packer means of said downhole tool apparatus, said sealed well annulus zone being defined between said upper and lower packer means.

11. A well test string, comprising:

a well tester valve apparatus including:

a housing having a flow passage disposed therethrough;

a flow tester valve disposed in said flow passage, and movable between a first position wherein said flow passage is closed and a second position wherein said flow passage is open;

upper packer means, disposed about said housing, for sealing between said housing and a well bore and for thereby defining an upper end of a sealed well annulus zone external of said housing;

power piston means, disposed in said housing and operably associated with said flow tester valve, for moving said flow tester valve between its said first and second positions in response to changes in fluid pressure in an upper well annulus portion above said upper packer means;

compression passage means, disposed through said housing, for communicating a first side of said power piston means with a lower exterior surface of said housing below said upper packer means and thus with said sealed well annulus zone; and power passage means, disposed through said housing, for communicating a second side of said power piston means with an upper exterior surface of said housing above said upper packer means and thus with said upper well annulus portion;

a spacer tubing having an upper end connected to a lower end of said housing, and having a tubing bore communicated with said flow passage;

a lower packer means, connected to said spacer tubing for defining a lower end of said sealed well annulus zone, said lower packer means having a packer bore means for communicating said tubing bore and thus said flow passage with a well zone below said lower packer means; and wherein said upper and lower packer means are longitudinally spaced by a distance sufficient that said sealed well annulus zone has a volume sufficient that well fluid trapped in said sealed well annulus zone may be compressed to decrease a volume of said trapped well fluid by an amount substantially equal to a displacement of said power piston means as said power piston means moves from its first to its second position.

12. The well test string of claim 11, wherein:

said well fluid is drilling mud.

13. The well test string of claim 12, wherein:

said longitudinal spacing between said upper and lower packer means is at least approximately sixty feet.

14. The well test string of claim 11, wherein:

said well tester valve apparatus further includes a mechanical spring biasing means, operably associated with said power piston means and said housing, for biasing said power piston means back toward a first position thereof corresponding to said closed first position of said flow tester valve from a second position thereof corresponding to said open second position of said flow tester valve, said mechanical spring biasing means having sufficient biasing force to return said power piston means to its first position without the assistance of any biasing force from well fluid compressed in said sealed well annulus zone.

15. A method of operating a downhole tool string, said method comprising the steps of:

(a) providing in said tool string an operating element, a power piston operatively associated with said operating element, and upper and lower longitudinally spaced packer means;

(b) lowering said tool string into a well bore;

(c) sealing said upper and lower packer means between said tool string and said well bore, and thereby defining a sealed well annulus zone between said upper and lower packer means;

(d) communicating a lower pressure side of said power piston means with said sealed well annulus zone through a compression passage;

(e) applying an actuating pressure to a high pressure side of said power piston means;

(f) moving said power piston means in response to a difference between said actuating pressure and well fluid pressure within said sealed well annulus zone, and thereby operating said operating element;

(g) compressing well fluid within said sealed well annulus zone as said power piston means is moved to operate said operating element and thereby storing in fluid compression a portion of the energy applied to move said power piston means;

(h) subsequently decreasing a pressure applied to said high pressure side of said power piston means; and (i) expanding said compressed well fluid in said sealed well annulus zone, and thereby returning said power piston to an original position thereof.

16. The method of claim 15, wherein said step of (e) includes steps of:

communicating an upper well annulus portion located above said upper packer means with said high pressure side of said power piston means; and increasing a well annulus pressure in said upper well annulus portion.

17. The method of claim 15, wherein:

step (c) is carried out by manipulation of a tubing string which suspends said tool string within said well bore.

18. The method of claim 15, wherein:

said method is further characterized as a method of testing a subsurface formation intersecting said well bore below said lower packer means, said operating element of said tool string being a flow tester valve disposed in a flow passage of said tool string, and said flow passage being communicated with said subsurface formation below said lower packer means.

19. The method of claim 15, further comprising the step of:

resiliently biasing, by means of a mechanical spring, said power piston means back toward said original position thereof with a biasing force sufficient to return said power piston means to its said original position even in the absence of any assistance from said compressed well fluid within said sealed well annulus zone.

* * * * *

UNITED STATES PATENT AND TRADEMARK OFFICE

CERTIFICATE OF CORRECTION

PATENT NO. : 4,589,485

DATED : May 20, 1986

INVENTOR(S) : Gary Q. Wray

It is certified that error appears in the above-identified patent and that said Letters Patent is hereby corrected as shown below:

In column 12, line 9, delete the word [acting] and insert therefor --actuating--.
In column 12, line 44, delete the word [af] and insert therefor --of--.

Signed and Sealed this

Third Day of February, 1987

*Attest:*

DONALD J. QUIGG

*Attesting Officer*

*Commissioner of Patents and Trademarks*